US006659969B1

(12) United States Patent
Levitin

(10) Patent No.: US 6,659,969 B1
(45) Date of Patent: Dec. 9, 2003

(54) METHOD OF AND AN APPARATUS FOR EXERCISING

(76) Inventor: Mikhail Levitin, P.O. Box 102, Reeders, PA (US) 18352

( * ) Notice: Subject to any disclaimer, the term of this patent is extended or adjusted under 35 U.S.C. 154(b) by 0 days.

(21) Appl. No.: 09/504,863

(22) Filed: Feb. 16, 2000

(51) Int. Cl.[7] ..... A61H 7/00; A61H 15/00; A63B 21/015; A63B 21/02

(52) U.S. Cl. ..... 601/15; 482/124; 482/126; 601/15; 601/19; 601/20; 601/21; 601/23; 601/124; 601/125; 601/128; 601/132; 601/137; 601/143

(58) Field of Search ..... 601/15, 19, 20, 601/21, 124, 132, 143, 146, 131, 128, 129, 23; 482/124, 132, 74, 140, 83, 126

(56) References Cited

U.S. PATENT DOCUMENTS 662,083 A * 11/1900 McFadden ..... 601/132
681,331 A * 8/1901 Milkman ..... 601/128
781,683 A * 2/1905 Shepherd ..... 601/132
863,144 A * 8/1907 Bowser ..... 601/132
1,257,957 A * 2/1918 Kost ..... 601/20
1,516,344 A * 11/1924 Knowles ..... 601/132
1,700,633 A * 1/1929 Hendrickson ..... 601/132
2,227,724 A * 1/1941 Kosa, Sr ..... 601/132
4,846,159 A * 7/1989 Anzai et al. ..... 601/128
5,007,430 A * 4/1991 Dardik ..... 600/509
5,725,484 A * 3/1998 Burnham ..... 601/128
6,109,999 A * 8/2000 Kuo ..... 601/132
6,245,031 B1 * 6/2001 Pearson ..... 601/118

* cited by examiner

*Primary Examiner*—Danton D. DeMille

(57) ABSTRACT

Exercise is performed and an exerciser device is designed so that they use a massage belt with at least two ends and a chain of ovals composed of ceramic, crystals, wood, plastic or ferromagnetic materials, while a user holds one end of the belt and applies a punching imitating movement, while the other end offers resistance each arm alternating creates resistance to the other arm's motion.

20 Claims, 5 Drawing Sheets

H= 0.5" – 3.5"

H= 0.5" – 3.5"

Direction of the resistance

Direction of the resistance

METHOD OF AND AN APPARATUS FOR EXERCISING

BACKGROUND OF THE INVENTION

The present invention relates to a method of and an apparatus for exercising.

Methods and apparatuses of the above mentioned general type are known in the art. One of such apparatus is disclosed in U.S. Pat. No. 3,672,358 to Majewski, issued on Jun. 27, 1972. A massage device consisting of plurality of rollers having projections would not be able to provide smooth contact with a portion of the body and can create an irritation of the skin in some cases.

In U.S. Pat. No. 5,6767,638 to Shefi, issued on Oct. 14, 1994 a massaging device constructed as a set of disc-shaped rollers mounted on the ends of transversely positioned axles. The square of the contact of the device with a body on a square unit is twice bigger compare with the device disclosed in U.S. Pat. No. 3,672,358 and requires twice stronger efforts to provide the same depth of massaging effect. It also does not correlate well to a body structure.

In U.S. Pat. No. 5,643,182 to Engel, issued on Jul. 1 ,1997 an apparatus is applying rolling massaging pressure to opposite sides of bodily extremity that significantly limited the type and quality of therapeutic movement during the sessions.

In U.S. Pat. No. 4,796,616 to Panahpour, issued on Jan. 10, 1989 a massaging apparatus is having a plurality of balls mounted in a carrier and while on projecting ball portion is in contact with a user's body the other projecting ball portion is in contact with the floor or other relatively rigid surface. This creates serious restrictions by a user on a type of movement or a place of the application to the body.

In U.S. Pat. No. 5,725,484 to Burnham, issued on Mar. 10, 1998 a massager is having a plurality of balls mounted on a web network grid which does not allow a user to provide a cross section movements to the body and limits the type and quality of therapeutic movement during the sessions.

In U.S. Pat. No. 4,587,956 to Griffin, issued on May 13, 1986 a magnetic therapeutic device is having a plurality of magnets with fixed north and south poles positions in an application that could limit therapeutic benefits.

In U.S. Pat. No, 5,803,896 to Chen, issued on Sep. 8, 1998 a magnetic device has a local and static application to a user's ears along with hormonal supplementation. The device is limited in applications and has not been designated to be part of an exercise program.

In U.S. Pat. No. 5,817,000 to Souder, issued on Oct. 6, 1998 the application of the moving magnetic field is limited to a horizontal or vertical direction with a fixed orientation of the poles.

In U.S. Pat. No. 5,816,983 to Dawes et all, issued on Oct. 6, 1998 an aerobic bouncing chair for performing a variety of aerobic, body strengthening, stretching and lymphatic circulation exercises. The device is not portable and the system allows exercising with limited range of motions.

In U.S. Pat. No. 5,876,311 to Coates, et all, issued on Mar. 2, 1999 a rebound-type exercise device allows an individual to perform a sit and bounce exercise. The device is not portable and the system allows exercising with limited range of motions.

In U.S. Pat. No. 4,925,185 to Gongwer et all, issued on May 15, 1990 an exercise method provides increased heart rates and respiration while introducing variable resistance through a combination of muscular resistance aided by mechanical forth transference. Due to difference in strength of different group of muscles involved in work out the effectiveness of the exercise and the user's range of motions are limited.

In U.S. Pat. No. 5,007,430 to Dardik, issued on Apr. 16, 1991 describes a rhythmic biofeedback technique as a deviation of a heart rate while work out inside a target heart rate zone and relaxation.

In conclusion, a need exists for developing therapeutic exercise program that is enjoyable, safe and simple, effective, universal and affordable and could combine work out with resistance with massage, reflexology, and acupressure at the same time. It also requires a simple and portable device, which could allow one to start the system in almost any environment. Complementation the system with magnetic therapy can add some therapeutic benefits to the program.

SUMMARY OF THE INVENTION

Accordingly, it is an object of the present invention to provide a method of and an apparatus for exercising, which avoids the disadvantages of the prior art.

More particularly, it is an object of present invention to provide a method of and an apparatus for exercising which achieves substantial health maintenance, rehabilitation, improvement of athletic performance, or to reaching a high level of vitality, etc.

In keeping with these objects and with others which will become apparent hereinafter, one feature of present invention resides, briefly stated, in a method of exercising in accordance with which a belt including a plurality of substantially oval elements is applied around a part of a body, the ends of the belt are kept by hands of an exercising person, and successive punching-imitating movements are performed by the hands of the exercising person, so that the oval bodies of the belt provide massaging, acupressure and reflexology actions at the same time.

In accordance with another feature of present invention, an inventive apparatus is formed as a belt which is provided with a plurality of oval elements, with free ends of the belt adapted to be grasped by an exercising person which will then deliver punching-imitating movements, so that the oval body provide massaging, acupuncture, and reflexology actions to a part of the body at the same time.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
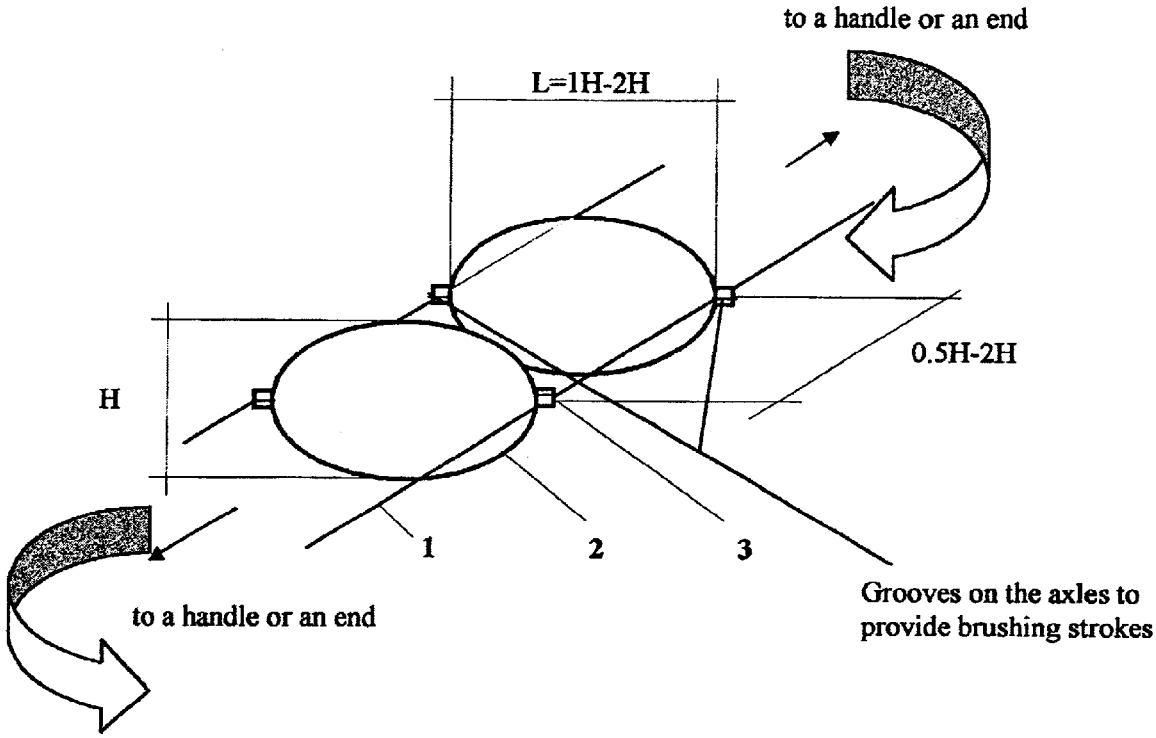
FIG. 1 is a view schematically showing an exercising apparatus in accordance with the present invention.

As shown in FIG. 1, an exercising device is formed as a massage belt which includes a flexible frame 1 and a plurality of oval bodies 2 which are carried by the frame 1 and are freely rotatable about axles positioned in the frame 1. The dimensions of the parts of the massage belt are selected relative to one another substantially as shown in FIG. 1.

In accordance with the present invention, a method of exercising is performed by placing the ovals 2 in contact with a portion of the body, and then pulling successively by a user one end and the other end by imitating punching actions with the hands. During this process, when an end is pulled the other end of the device renders a corresponding resistance. The dimension H of the wall ovals vary from 0.5 inch to 2 inch, while the dimension L various from H to 2 H, and a space between the two next ovals in the line vary from 0.5 H to 2 H for the best contact with the human body.

Figure 2:
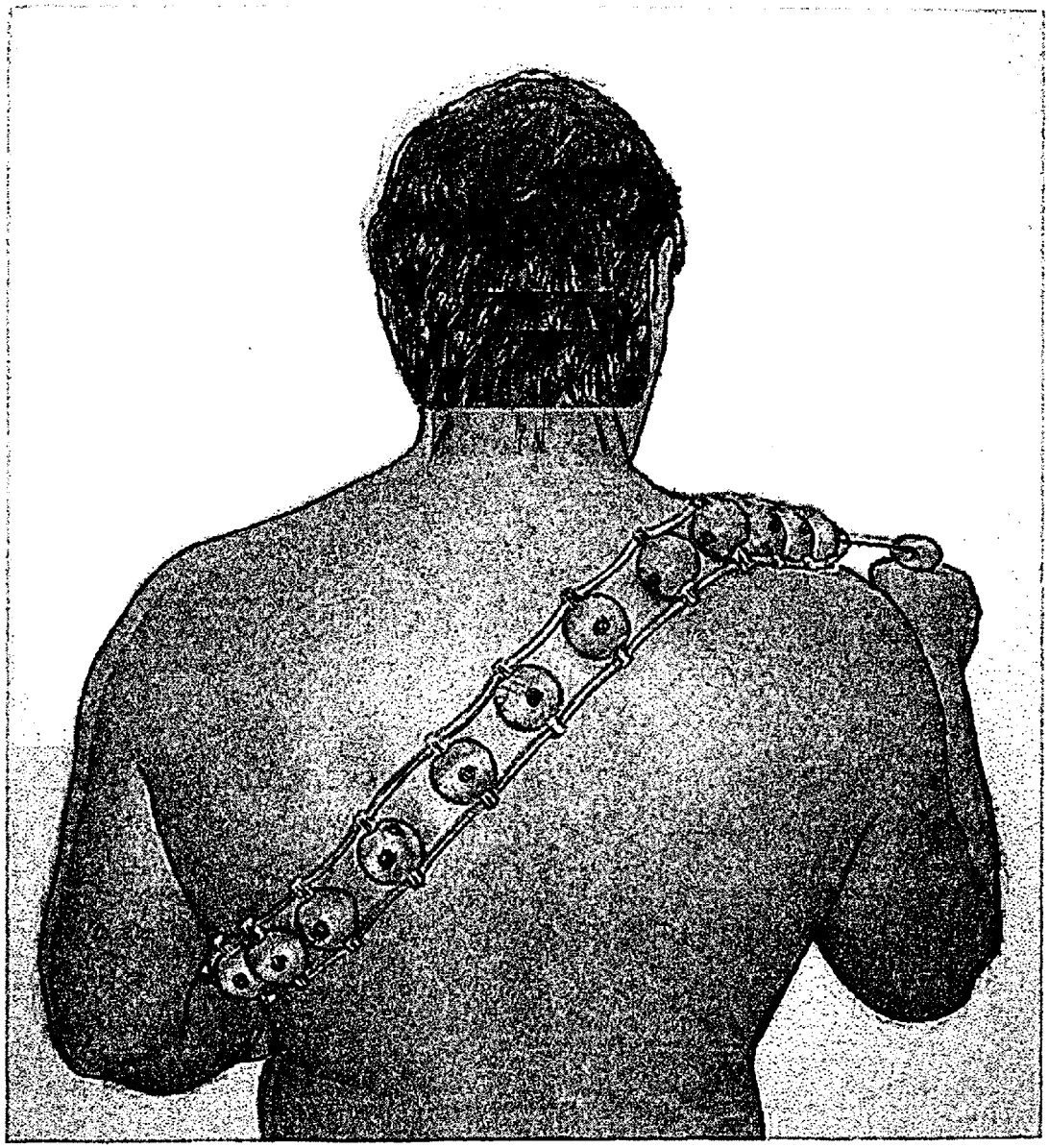
FIG. 2 is a view illustrating a method of exercising with the inventive device.

FIG. 2 illustrates a method of exercising, the user performs a punching-imitating movement by one hand holding one end of the belt or a handle on the one end, while the other end renders a corresponding resistance and vice versa. The movements of the hands are alternate with one another.

Figure 3:
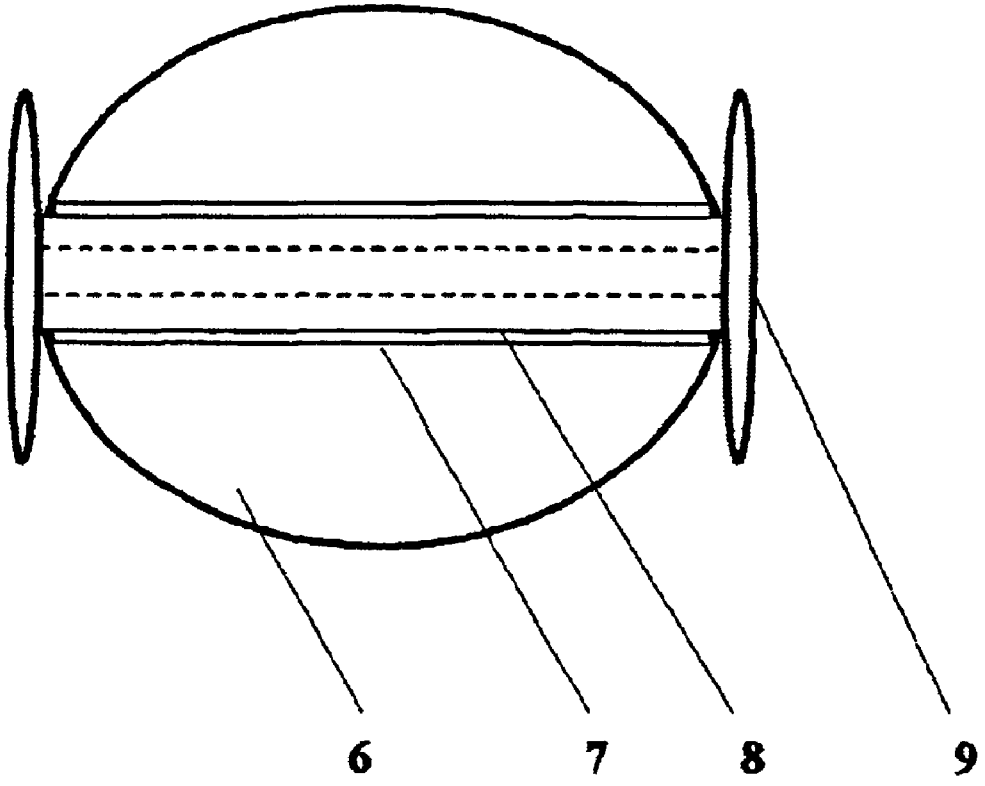
FIG. 3 is a view showing another modification of the inventive device.

FIG. 3 shows an exercising device in accordance with a further embodiment of the present invention. At least one ferromagnetic oval 6 is carried by a frame and is freely rotatable about an axle 7. The axles are formed as solenoids with metal coils 8 and connected to symmetrical poles 9 for discharging microcurrents conducted in solenoids 7.

Figure 4:
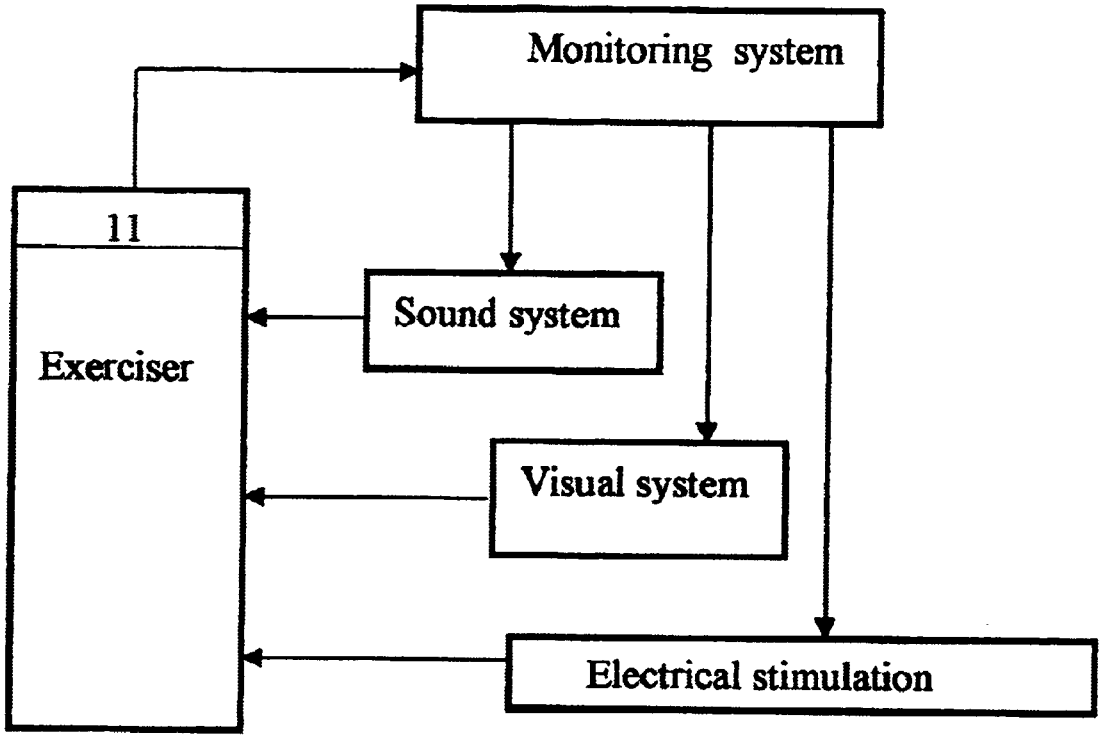
FIG. 4 is a view schematically showing an exercising method, with various actions.

In the embodiment shown in FIG. 4, the exercising device has a controller 11 which operates so that a corresponding heart rate value or an oxygen level consumption sensed by the controller 11 triggers a monitoring system for generating rhythmic soothing, visual signs and/or electrical stimulation to selected groups of muscles. As a result, the exercising program is complimented by music, visual signs and/or electrical signals.

Figure 5:
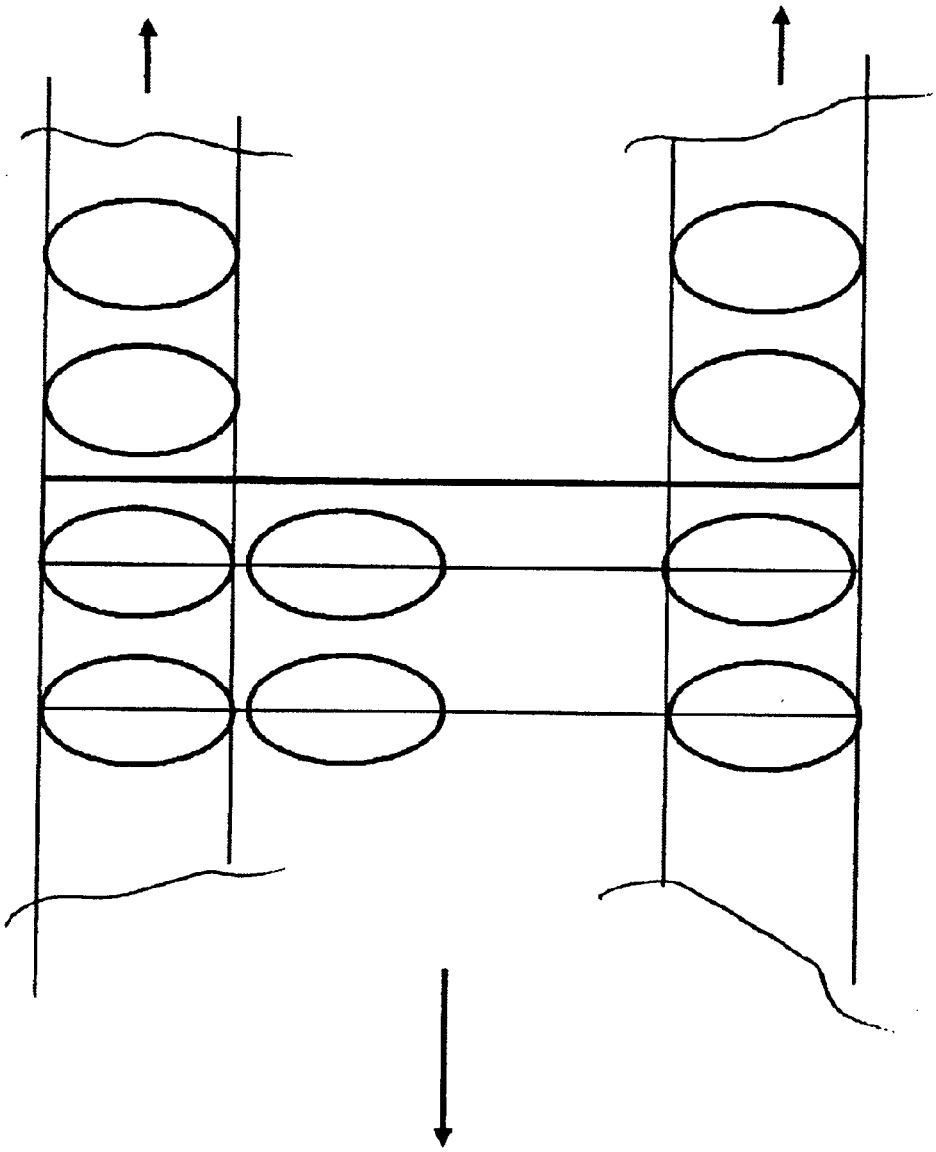
FIG. 5 is a view schematically showing a device with further embodiment.

In the embodiment shown in FIG. 5, an exercising device is formed as the device in FIG. 1 but has at least three handles/ends with varying width of the frame connecting two handles.

The ovals can be composed of ceramic, crystals, wood, plastic or ferromagnetic materials as described in FIG. 3. Stimulation occurs when the ovals are placed in contact with a portion of the body, and the massage belt is pulled alternatingly by its one end, (by hand or by a handle), with adequate resistance of the other end of the device. The energy spent during exercising provides health benefits, and the time required to reach a therapeutic effect is shorter when using a treadmill, a bicycle, etc.

When a user exercises within the inventive apparatus and in accordance with the inventive method, a muscular system is activated or relaxed, heart rates and respiration increase, blood circulation improves, trigger points and major meridians of a body are stimulated, and a variable resistance to exercising is introduced through different intensity of massage, reflexology and an acupressure. The user benefits from aerobic or anaerobic activities with the use of the resistance.

In accordance with the embodiment when the ovals are magnetic, they provide constantly changing and moving magnetic field, magnetic flux concentration is within the range of 0.1–50,000 gauss per square inch. When the ovals are formed of plastic, then during the exercising they provide constantly discharged static electricity at locations of placing of the contact ovals on the body.

In accordance with the present invention the exercising can be performed by rhythmic punching movements with the massage belt applied to a neck, a cheek, and/or an ear, knees flexed from 0° to 90°. Also, the rhythmic punching movements can be performed with a massage belt applied to a neck and/or chest area, with knees flexed from 0° to 90°. The rhythmic punching movements can be provided with a massage belt applied to a neck and/or shoulder, with knees flexed from 0° to 90°. The rhythmic punching movements can be also performed with a massage belt applied to a back, with knees flexed from 0° to 90°. The rhythmic punch movements can be also provided with a massage belt applied to buttock areas, knees flexed from 0° to 90°. A cross-section movement can be applied to a leg, a with an elevated leg, or to a foot an while elevated leg swings in an opposite direction to the user's body. Arrhythmic punching motions can be provided with a massage belt loop around the body or ties in kriss-cross position with knees flexed from 0° to 90°.

The exercising can be combined with rhythmic bouncing by an exerciser, rhythmic breathing by an exerciser with a coordinated body twisting by an exerciser.

In accordance with the present invention also an electronic monitoring of a single or a complex parameter of an optimal heartbeat or an optimal oxygen consumption level of an exerciser is provided, by means which are used for electronically monitoring a heartbeat or an oxygen consumption. Also, in accordance with the present invention the exercising can be accompanied by triggering a sound, a visual image, and/or an electrical stimulation, also by known means.

It will be understood that each of the elements described above, or two or more together, may also find a useful application in other types of methods and constructions differing from the types described above.

While the invention has been illustrated and described as embodied in a method of and an apparatus for exercising, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for exercising comprising;

a massage belt having at least two ends;

the belt comprising a plurality of oval bodies rotatably supported by axles extending perpendicular to the length of the belt, said oval bodies arranged in side by side relationship along the length of the belt;

the height dimension H of the oval body varies from 0.5 to 2 inches, the length dimension L varies from H to 2H, and the space between adjacent oval bodies varies from 0.5H to 3H, whereby when the user takes the ends of the belt and loops the belt over the user's body and imitates, with one end of the belt, a punching movement, while the other ends of the belt offers resistance, the dimensions and spacing of the oval bodies are such that the ends of the axles creating a massage therapy in the form of brushing strokes as well as acupressure and reflexology by the rotatable oval bodies;

said oval bodies are magnetic such that when the user imitates a punching movement microcurrents are generated by the revolving oval bodies through constantly changing and moving magnetic field with microcurrents generated through the axles made in the form of solenoids providing electrical stimulation to the user.

2. A device as defined in claim 1, wherein said ovals are magnetic revolving for providing a constantly changing and moving magnetic field.

3. A device as defined in claim 1; and further comprising means for electronically monitoring a single or complex parameter of an optimal heartbeat or an optimal oxygen consumption for operating the exercising device.

4. A device as defined in claim 1; and further comprising means for stimulation selected from the group consisting of a sound stimulation and a visual stimulation.

5. A method of exercising comprising the steps of providing a massage belt as set forth in claim 1;

holding said massage belt by two or more ends;

looping the belt over a part of the user's body and alternatively moving the hands one after another to imitate punching actions so that when one hand delivers a punching-like action and pulls one end of said belt, other ends of said belt offer a resistance, whereby massage, acupressure, and reflexology actions are applied to a corresponding part of the body.

6. A method as defined in claim 5, wherein said massage belt is applied to a neck, a cheek, and/or an ear with knees flexed from 0° to 90°.

7. A method as defined in claim 5, wherein rhythmic punching repetitive motions movements with a massage belt are applied to a neck and/or chest area, with knees flexed from 0° to 90°.

8. A method as defined in claim 5, wherein said punching repetitive movements are performed with said massage belt applied to a neck and/or shoulder, with knees flexed from 0° to 90°.

9. A method as defined in claim 5, wherein said punching motions are performed with said massage belt applied to a back, with knees flexed from 0° to 90°.

10. A method as defined in claim 5, wherein said punching motions are performed with said massage belt is performed to said buttock area with knees flexed from 0° to 90°.

11. A method as defined in claim 5, wherein said massage belt applied to a foot, while an elevated leg swings in an opposite direction to an upper body.

12. A method as defined in claim 5, wherein said belt is looped around the body or thighs in kriss-cross position with knees flexed from 0° to 90°.

13. A method as defined in claim 5; and further comprising rhythmic action selected from the group consisting of bouncing and breathing by an exerciser.

14. A method as defined in claim 5, and further comprising a coordinated body twisting by an exerciser.

15. A method as defined in claim 5; and further comprising constantly discharging static electricity at locations where said ovals contact with a body of an exerciser.

16. A method as defined in claim 5, wherein said ovals are magnetic ovals, so that during exercising constantly changing and moving magnetic field is applied to a user.

17. A method as defined in claim 5; and further comprising electrical stimulation by micro electric current discharged from a solenoid which forms an axle for a magnetic oval.

18. A method as defined in claim 5, and further comprising electronically monitoring a single or a complex parameter of an optimal heartbeat or an optimal oxygen consumption level for an exerciser.

19. A method as defined in claim 5; and further comprising supplementary to the steps of providing a massage belt with a plurality of ovals, holding the massage belt arid alternatingly moving the hands, performing electrical stimulation by microelectric current.

20. A method as defined in claim 19; and further triggering a simulatron selected from the group consisting of a sound stimulation and a visual stimulation.

* * * * *